United States Patent [19]

Lundberg

[11] Patent Number: 4,823,964

[45] Date of Patent: Apr. 25, 1989

[54] HOLDER FOR PACKS OR PACKAGES

[76] Inventor: Nils-Arne Lundberg, Regementsvägen 31 C, S-852 38 Sundsvall, Sweden

[21] Appl. No.: 99,602

[22] Filed: Sep. 22, 1987

[30] Foreign Application Priority Data

Sep. 25, 1986 [SE] Sweden ..... 8604063

[51] Int. Cl.[4] ..... A47F 7/00

[52] U.S. Cl. ..... 211/57.1; 211/59.1; 248/220.4

[58] Field of Search ..... 211/57.1, 59.1, 54.1, 211/118, 113; 248/220.4, 220.3, 221.1, 244; 206/447, 390

[56] References Cited

U.S. PATENT DOCUMENTS

| | | | |
|---|---|---|---|
| 331,512 | 12/1885 | Martin | 211/57.1 |
| 674,245 | 5/1901 | Milliken . | |
| 920,132 | 5/1909 | Greener | 211/57.1 |
| 1,043,952 | 11/1912 | McKinney et al. | 211/59.1 |
| 3,912,084 | 10/1975 | Valiulis | 248/220.4 |
| 4,394,909 | 7/1983 | Valiulis et al. . | |

*Primary Examiner*—Reinaldo P. Machado
*Assistant Examiner*—Sarah A. Lechok Eley
*Attorney, Agent, or Firm*—Young & Thompson

[57] ABSTRACT

A holder for so-called pin-packs comprises two detachably connected main parts in the form of a cantilevering arm and a pin extending through holes in the upper end portions of the packs. The pin is carried by the arm at both ends. The end portion of the pin at the outer end of the arm is provided with a cutting knife blade. The outermost pack can be cut against the cutting edge of the blade from the hole in the pack and out to the outer edge thereof when the pack is pulled.

5 Claims, 3 Drawing Sheets

FIG. 1
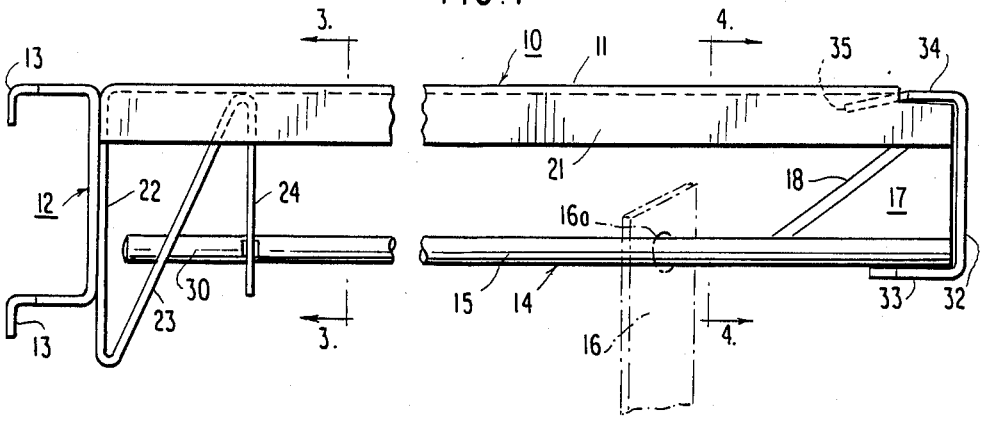
FIG. 2
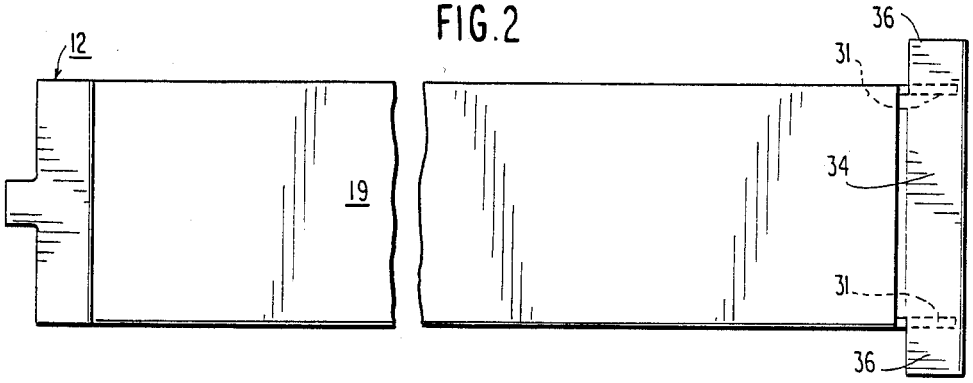
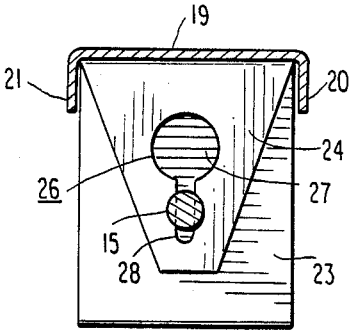
FIG. 3
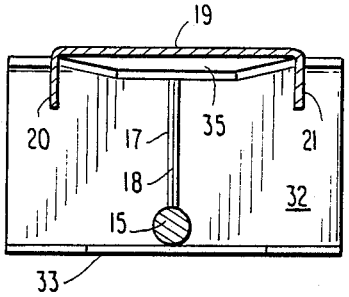
FIG. 4

HOLDER FOR PACKS OR PACKAGES

The present invention relates to a holder for packs or packages.

BRIEF DESCRIPTION OF THE PRIOR ART

Particularly in grocery stores there are a number of disadvantages with the pins used now for suspending so-called pin-packs. The pins are usually mounted in a horizontal position, and in most cases they have a bent-up free end for preventing the packs from unintentionally falling off when the outmost pack is taken away, as shown in U.S. Pat. No. 4,394,904. This bent-up end causes the disadvantages, however, that when more packs are to be placed on the pin, they must be put on one at a time instead of thrusting on a whole bunch of packs, which often like collected in a package with all the holes mutually in line.

Another disadvantage with the known pins is that when the pin is filled with further packs, possible remaining packs will always be farthest in on the pin. This means that there is a risk that packs can be left which are so old that there is a considerable difference between the price marking on the outermost new packs and the innermost relatively old packs. When it is a question of foodstuffs, the contents of the inmost packs may also become too old.

A still further disadvantage is that if a customer picks out a pack and then changes his mind, it may happen that he hangs up the pack on another pin with another kind of pack. Here there is the risk that a person, during an inventory, is not able to clearly see what type of packs are left.

A still further problem is that the pin must be relatively long, at least 40 cm, in relation to the depth of the shelves, which are used in many cases in grocery stores. If the packs are heavy, it may happen that a conventional pin will not be sufficiently strong.

There is also known a paper sack holder from U.S. Pat. No. 674,245. A nail is pierced through the sacks mounted to support the sacks. The sacks are torn off from the nail. If the sacks are made of plastics they could only be removed by first retracting the nail from the sacks.

SUMMARY OF THE INVENTION

The object of the invention is to provide a holder for the purpose in question which eliminates all the above-mentioned disadvantages with known pins for suspending so-called pin-packs. This is achieved with a holder which, in accordance with the invention, has the characterizing features defined in the following claims.

BRIEF DESCRIPTION OF THE FIGURES

A suitable embodiment of a holder in accordance with the invention is illustrated as an example in the accompanying drawings.

FIG. 1 is a fragmentary side view of a holder in accordance with the invention;

FIG. 2 is a view from above;

FIG. 3 is a section along the line 3—3 in FIG. 1;

FIG. 4 is a section along the line 4—4 in FIG. 1;

DETAILED DESCRIPTION

Figure 5:
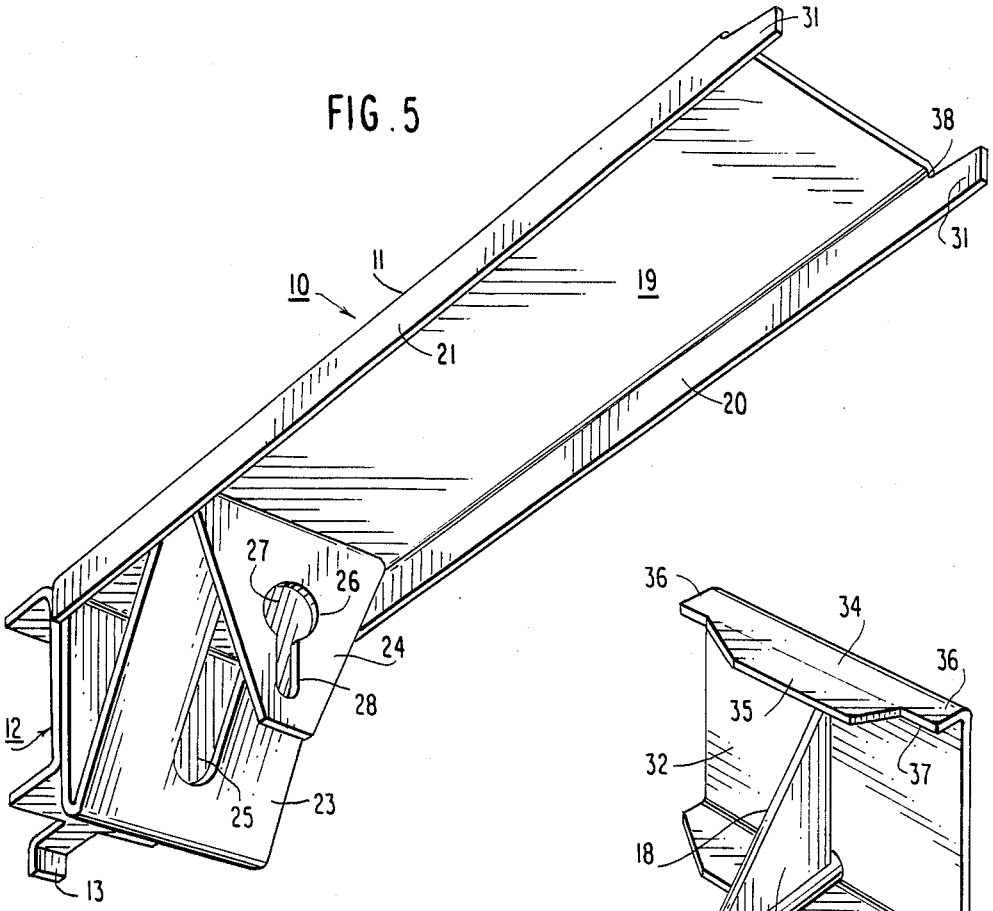
FIG. 5 illustrates the first main part of the holder seen obliquely from below.
Figure 6:
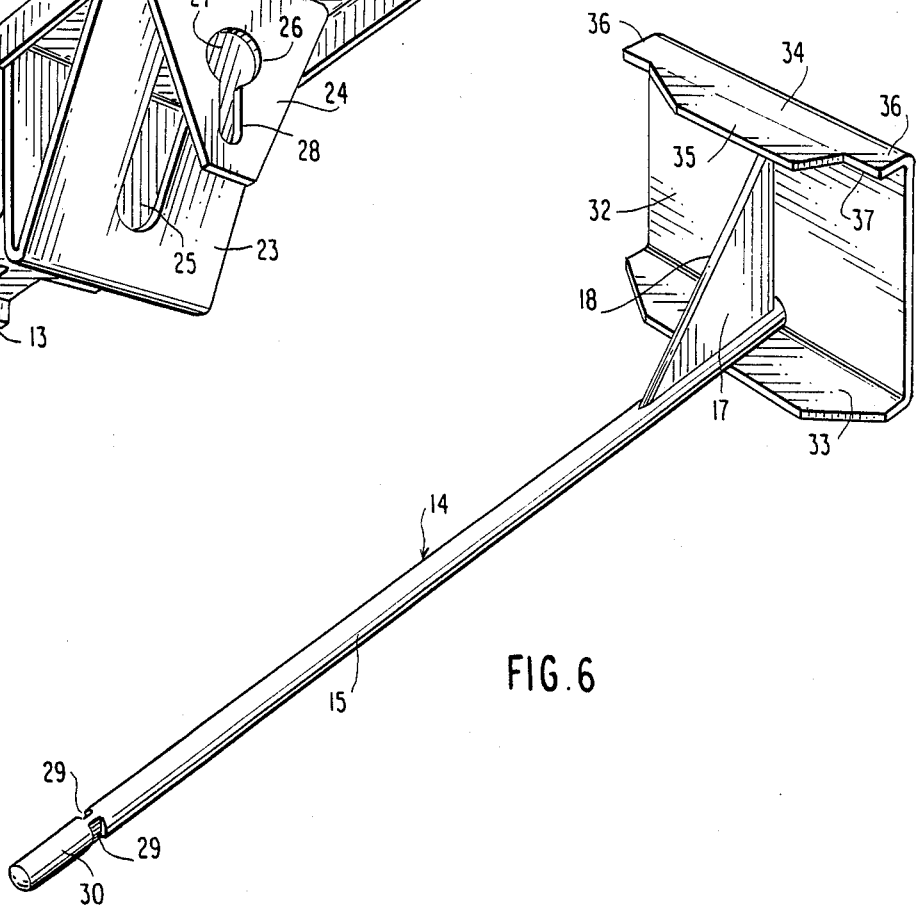
FIG. 6 illustrates the second main part of the holder seen obliquely from above.

The first main part 10 of the holder includes a long and stiff cantilevering arm 11 having a U section of metal plate with the capacity for taking up considerable loads, and which can therefore have a relatively large length, if so desired. At one end, the arm is provided with a conventional fitting 12 provided with a pair of hooks 13 for insertion into corresponding openings in a mounting panel (not shown), a post or the like. In a fitted state, the arm is usually horizontal, but it can also slope more or less upwards or downwards.

The second main part 14 of the holder includes a straight cylindrical pin 15 for receiving a plurality of hanging packs 16 provided with holes **16*a*** for hanging them on the pin. The pack casing usually consists of plastics film. The packs are often delivered in collected bundles or bunches, where the holes are mutually in line. The straight pin can thus be rapidly and surely inserted through the holes in all of the packs, instead of having to place these one after the other on a pin.

Both main parts can easily be connected together or can be disengaged from each other as is apparent from below.

At the outer end portion of the pin there is arranged a cutting means in the form of a knife blade 17, the cutting edge 18 of which extends, in the illustrated example, from the upper side of the pin obliquely upwards and backwards. If the pack is pulled against this cutting edge, the latter will cut through the upper edge portion of the pack, thereby releasing the pack from the pin. This cut prevent the customer from hanging up the pack again. Instead, the customer must leave the pack to the store staff, who can then quite simply tape the cut slit together and once again hang the pack in the right place, if the customer has changed his mind and does not want to have the removed pack.

Since the pin 15 is suspended, in a manner described below, at both its outer and inner ends, as illustrated in FIG. 1, it can be made longer than normal without any drawbacks, and thus accept a larger number of packs than is now usual. Time is saved in this manner, since it is not necessary to fill new packs as often as it would be with a shorter pin.

The arm 11 has a web portion 19 and two side flanges 20, 21. The web is extended at one end and bent down into an end wall 22, which in turn is bent up into a sloping intermediate wall 23, this being bent over at its upper end into a carrying plate 24 substantially perpendicular to the arm.

The fitting 12 with the two hooks 13 is attached to the end wall 22.

A slot 25 is made in the intermediate wall 23 to give room for the end portion of the pin. A keyhole 26 is made in the plate 24 and has a large opening 27 for inserting the pin. This opening merges into a downwardly directed slot 28, the width of which is less than the diameter of the pin 15. The pin is provided with at least one transverse recess 29, or suitably two such recesses on either side of it in its fitted position, in order that it shall be able to fall down into the slot 28 when it is in its fully inwardly thrust position. The pin can thus fall down into a position in the slot 28 such as to lock it against axial displacement.

In this connection, it is pointed out that the length of the free end portion 30 of the pin from the recesses 29 and out to the end of the pin is so great that this portion can serve as a comfortable support in fitting the pin, when the portion 30 lies against the edge of the opening 27 and until the pin falls into its locked position.

At the outer end of the arm the side flanges are extended by two ears 31 carrying the outer end of the pin in a manner described below.

The pin attached to an end plate 32, downwardly having an inwardly bent flange 33 and upwardly an inwardly bent support flange 34.

The middle portion of the support flange 34 is formed with an extension or tongue 35, which is somewhat downwardly bent. On either side of the tongue the flange 34 has remaining corner flaps 36. If the pin has some packs left on it, and is to be filled with new packs, this is readily performed by the pin being threaded through the holes in a package of new packs. The old packs will lie nearest to the knife 17 and will thus be those which are torn off first.

The end portion of the pin is then guided into the large opening 27 of the keyhole and can rest against its edge as the tongue 35 is guided between the side flanges 20 and 21 of the arm and so that the corner flaps 36 are guided on the edges of the ears 31. All that then remains is to press in the pin to its innermost end position which is limited by the stop means formed by the edges 37 of the corner flaps 36 engaging against the edges 38 below the end of the web. In this position, the recesses 29 on the pin are immediately above the slot 28 of the keyhole and the pin falls down by itself into this slot, thus locking it in a simple manner. When a pack is to be pulled off, the pack is held and drawn towards the knife 17 which easily cuts through the edge portion of the pack so that it becomes free. The cutting edge 18 of the cutting means may have an angle to the pin other than the approximately 45 degrees illustrated, but in practice this angle has been found to function satisfactorily.

Figure 7:
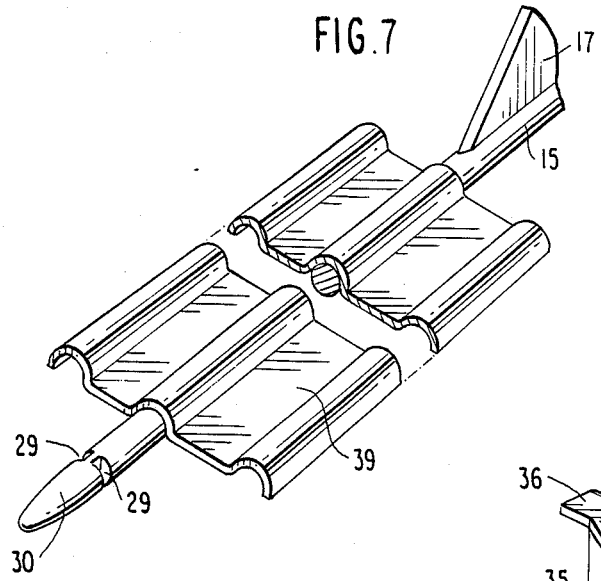
FIG. 7 illustrates the pin reinforced with a wide strip.

It is illustrated in FIG. 7 how the pin 15 is reinforced by a metal strip 39 fitting into the slot which is to be found in the piece of carton, which can be conventionally attached to the pack, e.g. with the aid of shrink film. This strip increases the stiffness of the pin and keeps the packs in the same position relative each other.

Figure 8:
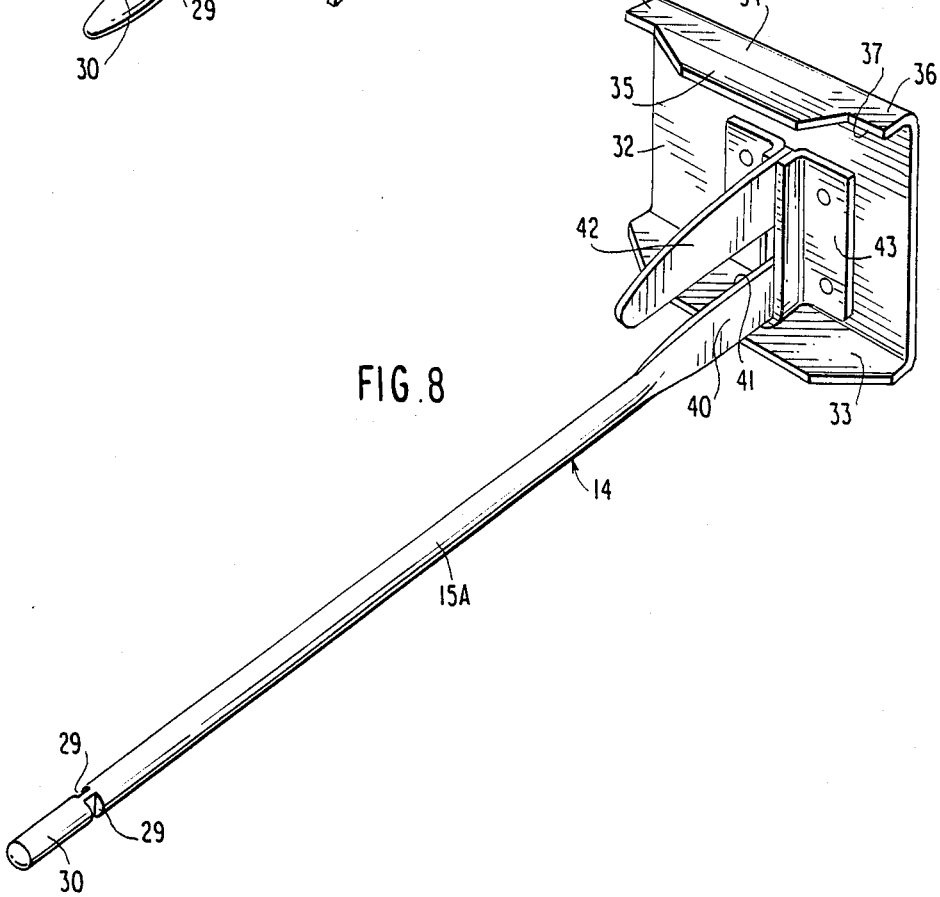
FIG. 8 shows a modification of the knife in FIG. 6.

In FIG. 8 the pin 15A is flattened at its outer end to provide a blade 40 having a cutting edge 41 at its upper edge substantially parallel with the pin 15A. A protecting tongue 42 is provided above the edge 41 and is secured to the end wall 32 by means of a bracket 43 which also secures the flattened end of the pin 15A. The tongue 42 will eliminate the risk that a finger of a person comes into contact with the cutting edge 41.

I claim:

1. A holder for packages having a plastic film casing containing a hole for suspension of the package from the holder, comprising (a) a cantilevered horizontal arm adapted for connection at one end with a fixed structure, said arm including at said one end a carrying assembly;

(b) a horizontal pin including connecting means at one end thereof for removable connection with the other end of said arm, the other end of said pin being fixed within said carrying assembly of said arm, said pin being arranged parallel to and below said arm in spaced relation therefrom; and (c) a cutting assembly connected with only a partial extent of said pin adjacent said connecting means, said cutting assembly including a cutting edge extending upwardly toward and adjacent to said arm, whereby when said pin is disconnected from said arm, a plurality of packages are arranged on and suspended from said pin by passing said pin through said package holes, and when said pin is connected with said arm, the outermost package adjacent said pin one end is removed from the holder by pulling the package across said cutting edge to cut the package adjacent the package hole to the edge of the package.

2. A holder for packages having a plastic film casing containing a hole for suspension of a package from the holder, comprising (a) a cantilevered horizontal arm adapted for connection at one end with a fixed structure, said arm including at said one end a carrying assembly, said arm having a U-shaped cross-sectional configuration including a horizontal web and two downwardly directed side edge flanges merging at the other end of said arm into two ears;

(b) a horizontal pin including connecting means at one end thereof for removable connection with the other end of said arm, the other end of said pin being fixed within said carrying assembly of said arm, said pin being arranged parallel to and below said arm in spaced relation therefrom, said connecting means including an end plate perpendicular to said pin and formed at its upper end with an inwardly directed edge flange, said flange including a tongue insertable between said arm ears and under said arm web simultaneously as two corner flaps on either side of said tongue, respectively, rest on the upper edges of said ears; and (c) a cutting assembly connected with said pin adjacent said connecting means, said cutting assembly including a cutting edge extending upwardly toward said arm, whereby when said pin is disconnected from said arm, a plurality of packages are arranged on and suspended from said pin by passing said pin through said package holes, and when said pin is connected with said arm, the outermost package adjacent said pin one end is removed from the holder by pulling the package across said cutting edge to cut the package adjacent the package hole to the edge of the package.

3. A holder for packages having a plastic film casing containing a hole for suspension of a package from the holder, comprising (a) a cantilevered horizontal arm adapted for connection at one end with a fixed structure, said arm including at said one end a carrying assembly comprising a plate extending downwardly from said arm and containing a keyhole, the slot portion of said keyhole extending downwardly;

(b) a horizontal pin including connecting means at one end thereof for removable connection with the other end of said arm, the other end of said pin passing through said keyhole of said carrying means when said connecting means are connected with said arm one end, said pin containing a pair of vertical recesses for receiving portions of said carrying assembly plate, whereby said pin is locked into said keyhole slot of said carrying means, said pin being arranged parallel to and below said arm in spaced relation therefrom; and (c) a cutting assembly connected with said pin adjacent said connecting means, said cutting assembly including a cutting edge extending upwardly toward said arm, whereby when said pin is disconnected from said arm, a plurality of packages are arranged on and suspended from said pin by passing said pin through said package holes, and when said pin is connected with said arm, the outermost package adjacent said pin one end is removed from the holder by pulling the package across said cutting edge to cut the package adjacent the package hole to the edge of the package.

4. A holder for packages having a plastic film casing containing a hole for suspension of a package from the holder, comprising (a) a cantilevered horizontal arm adapted for connection at one end with a fixed structure, said arm including at said one end a carrying assembly;

(b) a horizontal pin including connecting means at one end thereof for removable connection with the other end of said arm, the other end of said pin being fixed within said carrying assembly of said arm, said pin being arranged parallel to and below said arm in spaced relation therefrom and including a longitudinal wide strip forming a wing on either side of said pin for reinforcing said pin; and (c) a cutting assembly connected with said pin adjacent said connecting means, said cutting assembly including a cutting edge extending upwardly toward said arm, whereby when said pin is disconnected from said arm, a plurality of packages are arranged on and suspended from said pin by passing said pin through said package holes, and when said pin is connected with said arm, the outermost package adjacent said pin one end is removed from the holder by pulling the package across said cutting edge to cut the package adjacent the package hole to the edge of the package.

5. A holder for packages having a plastic film casing containing a hole for suspension of a package from the holder, comprising (a) a cantilevered horizontal arm adapted for connection at one end with a fixed structure, said arm including at said one end a carrying assembly;

(b) a horizontal pin including connecting means at one end thereof for removable connection with the other end of said arm, the other end of said pin being fixed within said carrying assembly of said arm, said pin being arranged parallel to and below said arm in spaced relation therefrom;

(c) a cutting assembly connected with said pin adjacent said connecting means, said cutting assembly including a cutting edge located at the upper side of the pin along a limited extent thereof and extending substantially parallel therewith; and (d) a protecting tongue connected with said pin and arranged above said cutting edge in spaced relation thereto to prevent a person's finger from coming into contact with said cutting edge, whereby when said pin is disconnected from said arm, a plurality of packages are arranged on and suspended from said pin by passing said pin through said package holes, and when said pin is connected with said arm, the outermost package adjacent said pin one end is removed from the holder by pulling the package across said cutting edge to cut the package adjacent the package hole to the edge of the package.

* * * * *